United States Patent [19]

Tatsuno

[11] Patent Number: 4,888,828

[45] Date of Patent: Dec. 26, 1989

[54] SLEEPING BAG DEVICE

[75] Inventor: Isamu Tatsuno, Osaka, Japan

[73] Assignee: Mont-Bell Co., Ltd., Osaka, Japan

[21] Appl. No.: 255,393

[22] Filed: Oct. 11, 1988

[30] Foreign Application Priority Data

Oct. 26, 1987 [JP] Japan ..... 62-164275
Aug. 1, 1988 [JP] Japan ..... 63-102153

[51] Int. Cl.[4] ..... A41D 13/00
[52] U.S. Cl. ..... 2/69.5; 5/413
[58] Field of Search ..... 2/69.5; 5/413

[56] References Cited

U.S. PATENT DOCUMENTS

| | | | |
|---|---|---|---|
| 2,242,130 | 5/1941 | Hutchison | 2/69.5 |
| 2,328,938 | 9/1943 | Wilson | 2/69.5 |
| 2,431,603 | 11/1947 | Zito | 2/69.5 |
| 2,707,988 | 5/1955 | Shaub | 2/69.5 |
| 3,857,125 | 12/1974 | Hunt | 2/69.5 |
| 4,354,281 | 10/1982 | Satoh | 2/69.5 |

FOREIGN PATENT DOCUMENTS

| | | | |
|---|---|---|---|
| 64792 | 11/1982 | European Pat. Off. | 5/413 |
| 930622 | 7/1955 | Fed. Rep. of Germany . | |
| 2712336 | 9/1978 | Fed. Rep. of Germany | 5/413 |
| 1138389 | 6/1957 | France | 2/69.5 |
| 1222262 | 6/1960 | France | 2/69.5 |
| 2485905 | 1/1982 | France . | |
| 21668 | 5/1980 | Japan . | |
| 22938 | 5/1980 | Japan . | |
| 10217 | 3/1981 | Japan . | |
| 10218 | 3/1981 | Japan . | |
| 10219 | 3/1981 | Japan . | |
| 30306 | 7/1981 | Japan . | |
| 15743 | 4/1982 | Japan . | |
| 40865 | 9/1982 | Japan . | |
| 45909 | 10/1982 | Japan . | |
| 430530 | 7/1935 | United Kingdom . | |

*Primary Examiner*—Werner H. Schroeder
*Assistant Examiner*—Diana L. Biefeld
*Attorney, Agent, or Firm*—Oliff & Berridge

[57] ABSTRACT

A sleeping bag device has a heat-retaining bag which defines an inner chamber for accommodating the user's body and having a head opening serving as an entrance/exit. The device also has an elastic member or members which compress the warmth-retaining bag in such a manner as to reduce the cross-sectional area of the inner chamber, thus allowing the bag to closely fit around the user's body.

15 Claims, 3 Drawing Sheets

SLEEPING BAG DEVICE

BACKGROUND OF THE INVENTION

The present invention relates to a sleeping bag device which is suitable for bivouac use during mounting climbing, hiking and so forth.

In general, a sleeping bag device has an elongated inner chamber or cavity for accommodating the user's body, and warmth-retaining means surrounding the inner cavity and having a head opening serving as an entrance/exit which enables the user to enter and leave the inner cavity. Usually, the warmth-retaining means has a layer of heat-insulating material such as cotton which fills a space defined between inner and outer water-proof cloth lining sheets. The heat-insulating material is suitably quilted by sewing both cloth liner sheets so that local concentration of the heat-insulating material due to movement thereof is avoided.

A gap is inevitably formed between the user's body as it lies in the sleeping bag device and the warmth-retaining means, more precisely, the inner cloth lining sheet. Obviously, a smaller gap provides a higher warmth-retaining efficiency. Unfortunately, no sleeping bag device so far proposed includes measures for positively reducing the size of this gap. When the user turns in sleep, some of the air in the gap is forced out of the sleeping bag device to dissipate heat with the result that the warmth in the sleeping bag device cannot be efficiently retained. This problem is particularly critical where the size of the user's body is small relative to the size of the sleeping bag device.

SUMMARY OF THE INVENTION

Accordingly, an object of the present invention is to provide an improved sleeping bag device that overcomes the above-described problems encountered with known sleeping bag devices and provides a higher warmth-retaining efficiency.

To this end, the present invention provides a sleeping bag device which comprises warmth-retaining means defining an elongated inner cavity and capable of thermally insulating the inner cavity from ambient air, a head opening provided in the warmth-retaining means, and elastic means which elastically compress the warmth-retaining means in such a manner as to reduce the cross-sectional area of the inner cavity.

Preferably, the elastic compression means is provided at least in the portion of the sleeping bag device near the head opening.

The warmth-retaining means includes an inner cloth lining sheet, an outer cloth lining sheet and a heat-insulating layer of heat-insulating material filling the space between these cloth lining sheets. The elastic compression means is preferably sewn to the inner or outer cloth lining sheet.

The elastic compression means may include a ring made of rubber.

The sleeping bag device of the invention may further comprise an outer bag which is wrapped around the sleeping bag device and having a construction which is substantially the same as the described construction of the sleeping bag device. In such a case, a double-bag structure is provided which includes an inner bag and an outer bag wrapping around or enclosing the inner bag. Preferably, the elastic compression means of the inner bag is provided on the outer face of the warmth-retaining means of the inner bag, while the elastic compression means of the outer bag is secured to the inner surface of the warmth-retaining means of the outer bag.

In use, the elastic compression means acts to compress or contract the warmth-retaining means into close contact with the body of the sleeper lying in the cavity so that the size of the gap between the sleeper's body and the inner cloth lining sheet of the warmth-retaining means is reduced to suppress the movement of air in the sleeping bag device, whereby the undesirable dissipation of heat is prevented and the warmth-retaining efficiency is improved. In particular, the elastic compression means disposed in the vicinity of the head opening of the sleeping bag device serves to minimize leakage of warm air so that the undesirable dissipation of heat is reduced. The double-bag structure composed of inner and outer bags having substantially the same construction exhibits an even better warmth-retaining effect.

The invention will be more fully understood from the following description of preferred embodiments.

DESCRIPTION OF THE PREFERRED EMBODIMENTS

Figure 1:
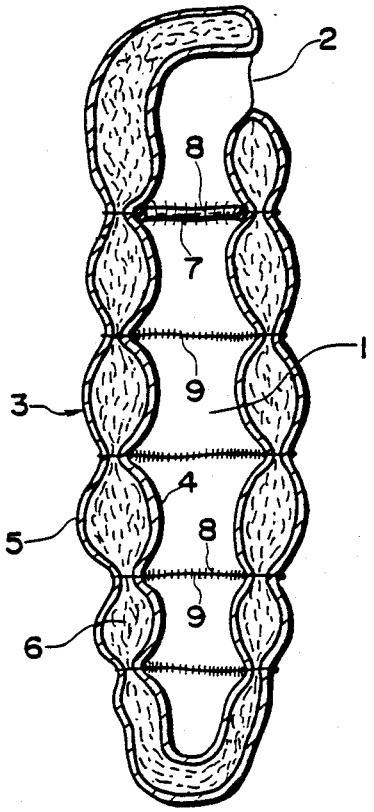
FIG. 1 is a longitudinal sectional view of an embodiment of a sleeping bag device in accordance with the present invention.
Figure 2:
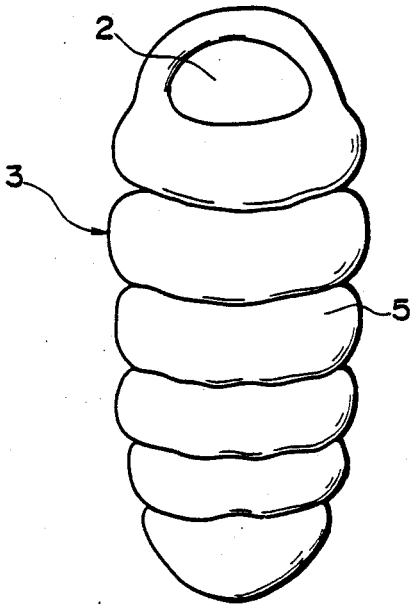
FIG. 2 is a plan view of the embodiment of FIG. 1.
Figure 3:
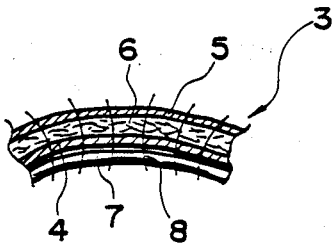
FIG. 3 is an enlarged sectional view taken along the line III—III of FIG. 1.

A first embodiment of the sleeping bag device in accordance with the present invention will be described hereinunder with reference to FIGS. 1 to 3.

The first embodiment of the sleeping bag device has a warmth-retaining bag 3 which defines an elongated cavity 1 for accommodating the user's body and which has an opening 2 that allows the user to enter and leave the cavity 1. The wall of the warmth-retaining bag 3 is composed of an inner cloth lining sheet 4, an outer cloth lining sheet 5 and a layer of heat-insulating material 6 such as cotton filling the gap between the inner and outer cloth lining sheets. The sleeping bag device also has an elastic member 7 which is disposed in the vicinity of the head opening 2 of the warmth-retaining bag 3 and which serves to compress the warmth-retaining bag 3 in such a manner as to decrease the cross-sectional area of the cavity 1.

In this embodiment, though not exclusively, the elastic member 7 is a ring-shaped rubber member which is fixed to the inner cloth lining sheet 4 by, for example, machine sewing with threads 8. The elastic member 7 in the form of a ring-shaped rubber member is only illustrative. Thus, the elastic member may be realized by one of the upper and under threads which are used in machine-sewing the inner and outer cloth lining sheets to each other. The elastic member 7 also may be formed of rubber threads interposed between the upper and under threads. In either case, the elastic member 7 may be fixed to the cloth lining sheet in a zig-zag form though a straight ring is shown in FIG. 1. In the illustrated embodiment, the elastic member 7 is provided only in one portion adjacent the head opening 2 of the sleeping bag device as illustrated. The inner and outer cloth lining sheets 4 and 5, with the heat insulating layer 6 placed therebetween, are quilted with threads 8 and 9 in the same manner as known sleeping bag devices in regions other than the region where the elastic member 7 is provided.

When the sleeping bag device is used, the elastic member 7 serves to press the portion of the warmth-retaining bag 3 into resilient contact with the sleeper's body. In the illustrated embodiment, the elastic member 7 is disposed at a portion of the sleeping bag device corresponding to the neck of the sleeper's body. Therefore, the portion of the warmth-retaining bag 3 is held in slight resilient contact with the sleeper's neck so that the air in the sleeping bag device can move only within the space around the body of the sleeper, but not through the neck portion. The elastic member 7 also serves to prevent the interior of the sleeping bag device from communicating with the ambient air, so that undesirable escape of warm air from the interior and induction of cold ambient air into the sleeping bag device are avoided. In consequence, dissipation of heat is suppressed to a remarkable extent such as to improve the warmth-retaining effect. The elastic compression member 7 keeps the portion of the warmth-retaining bag in resilient contact with the neck of the sleeper so as not to restrict the movement of the sleeper's body which allows a sound sleep as compared with cases where the neck portion of the sleeping sack is tightened by a non-expandable string. It is also to be noted that the elastic member 7 which is secured to the inner lining cloth sheet 4 is not exposed directly to the exterior and, therefore, is effectively prevented against any external damaging force so that it can endure a long use.

Figure 4:
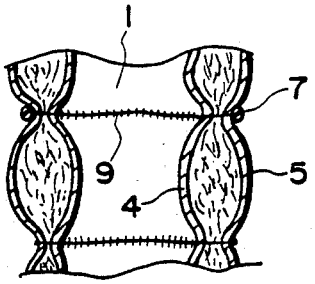
FIGS. 4 to 7 are longitudinal sectional views of different embodiments, respectively.

FIG. 4 shows another embodiment of the present invention which is materially the same as the first embodiment except that the elastic member 7 is secured to the outer cloth lining sheet 5.

Figure 5:
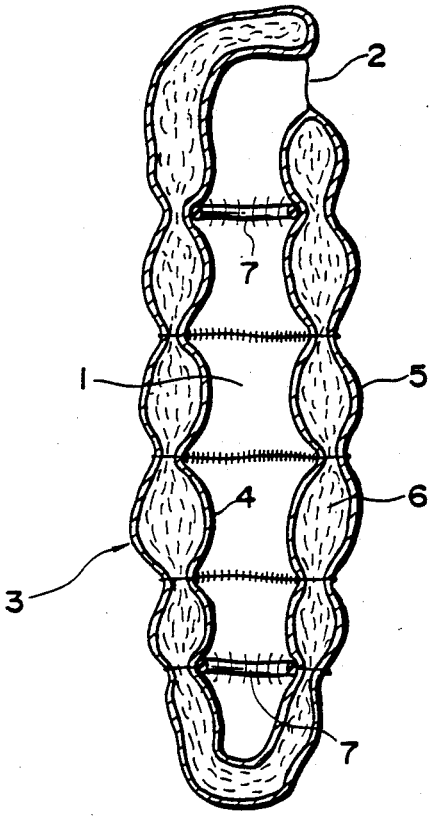

FIG. 5 shows still another embodiment which employs a pair of elastic members 7: namely, one located at a portion near the head opening 2 and the other located near the other end of the sleeping bag device in such a manner as to tighten around ankles of the sleeper. This arrangement allows the warmth-retaining bag 3 to deform in such a manner as to follow any change in the sleeper's posture and to adapt to a variety of body sizes of users.

Figure 6:
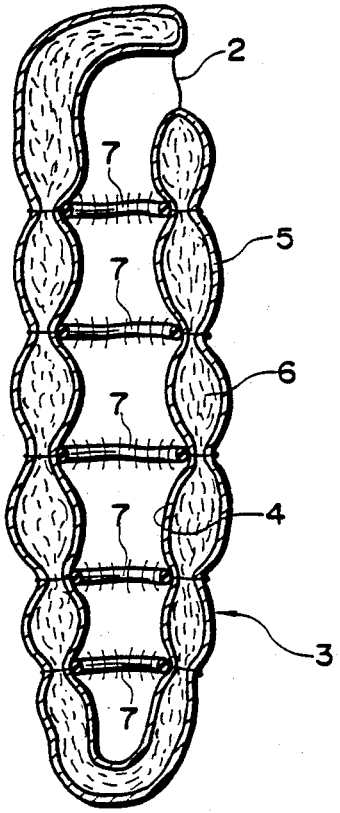

FIG. 6 shows a different embodiment of the invention which employs a plurality of elastic members 7 arranged at a substantially constant pitch in the longitudinal direction of the sleeping bag device. In consequence, the space formed between the sleeper's body and the inner cloth lining sheet is divided by the elastic members 7 into a plurality of sections so s to further limit the movement of the air in the longitudinal direction of the sleeping bag device so that the warmth-retaining effect is further enhanced. In addition, the warmth-retaining bag 3 is elastically contracted to fit around the sleeper's body over the entire length. In particular, the portions of the warmth-retaining bag 3 around the neck and ankles of the sleeper are held in contracted state so that the heat-insulating layer 6 is tightened to further enhance the warmth-preserving effect at least at these portions.

Figure 7:
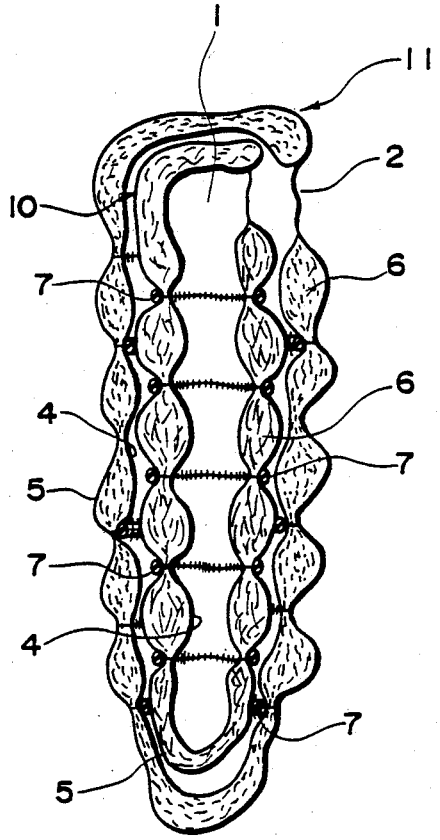

FIG. 7 shows a different embodiment of the sleeping bag device in accordance with the present invention. In this embodiment, an outer bag 11 is provided in such a manner as to materially envelope an inner bag 10, each of these bags having a construction substantially the same as one of the warmth-retaining bags in the preceding embodiments, thus providing a double-sack structure. The elastic member 7 of the inner bag 10 is secured to the outer side of the warmth-retaining bag, i.e., to the outer surface of the outer cloth lining sheet 4, of the inner bag 10, whereas, in the outer bag 11, the elastic member 7 is secured to the inner surface of the warmth-retaining bag 3.

As will be fully understood from the foregoing description, according to the present invention, the warmth-retaining bag is held in close contact with the sleeper's body at least partially, so that the movement of air in the sleeping bag device is suppressed so as to reduce wasteful dissipation of heat, thus attaining a remarkable improvement in the warmth-retaining effect.

What is claimed is:

1. A sleeping bag device comprising:

warmth-retaining means defining an elongated inner chamber for accommodating a user's body and being capable of thermally insulating the interior of said inner chamber from the ambient air;

a head opening provided in said warmth-retaining means and serving as an entrance/exit for enabling a user to enter and leave said inner chamber; and elastic means for compressing said warmth-retaining means in such a direction as to reduce the cross-sectional area of said inner chamber, said elastic means being provided adjacent said head opening of said warmth-retaining means, and second elastic means adjacent an opposite end of said warmth-retaining means from said head opening to reduce said inner chamber around the ankles of a user.

2. A sleeping bag device according to claim 1, wherein said elastic means is provided at a substantially constant pitch in the longitudinal direction of said warmth-retaining means over the entire length of said warmth-retaining means.

3. A sleeping bag device according to claim 1, wherein said warmth-retaining means includes an outer bag and an inner bag enclosed within said outer bag, each of said outer and inner bags comprises an inner lining, an outer lining and a heat-insulating material filling a space defined by said inner and outer linings.

4. A sleeping bag device according to claim 3, wherein said elastic means comprises a first length of rubber-like material fixed to said inner lining of said outer bag and a second length of rubber-like material fixed to said outer lining of said inner bag.

5. A sleeping bag device comprising:

a warmth-retaining bag comprising an inner lining, an outer lining and a heat-insulating material filling a space defined by said inner and outer linings, said warmth-retaining bag defining an elongated inner chamber for accommodating a user's body and a head opening adapted for a user to enter or leave said inner chamber; and a plurality of elastic threads fixed with a sewing thread onto either one of said inner and outer linings, said elastic threads disposed at a substantially constant pitch in a longitudinal direction of said warmth-retaining bag over the entire length of said warmth-retaining bag.

6. A sleeping bag device comprising:

warmth-retaining means defining an elongated inner chamber for accommodating a user's body and being capable of thermally insulating the interior of said inner chamber from the ambient air;

a head opening provided in said warmth-retaining means and serving as an entrance/exit for enabling a user to enter and leave said inner chamber; and elastic means for compressing said warmthretaining means in such a direction as to reduce the cross-sectional area of said inner chamber, said elastic means being provided adjacent said head opening of said warmth-retaining means and at a substantially constant pitch in the longitudinal direction of said warmth-retaining means over the entire length of said warmth-retaining means.

7. A sleeping bag device comprising:

warmth-retaining means defining an elongated inner chamber for accommodating a user's body and being capable of thermally insulating the interior of said inner chamber from the ambient air;

a head opening provided in said warmth-retaining means and serving as entrance/exit for enabling a user to enter and leave said inner chamber; and elastic means for compressing said warmth-retaining means in such a direction as to reduce the cross-sectional area of said inner chamber, said elastic means comprising a length of rubber-like material; and said warmth-retaining means comprising an inner lining, an outer lining and a heat-insulating material filling a space defined by said inner and outer linings, said elastic means being fixed to the inner lining.

8. A sleeping bag device according to claim 7, wherein said warmth-retaining means comprises an inner lining, an outer lining and a heat-insulating material filling a space defined by said inner and outer linings.

9. A sleeping bag device according to claim 8, wherein said elastic means comprises a length of rubber-like material fixed to said inner lining.

10. A sleeping bag device according to claim 8, wherein said elastic means comprises a length of rubber-like material fixed to said outer lining.

11. A sleeping bag device comprising:

warmth-retaining means defining an elongated inner chamber for accommodating a user's body and being capable of thermally insulating the interior of said inner chamber from the ambient air;

a head opening provided in said warmth-retaining means and serving as entrance/exit for enabling a user to enter and leave said inner chamber;

elastic means for compressing said warmthretaining means in such a direction as to reduce the crosssectional area of said of said inner chamber, said elastic means comprising a length of rubber-like material;

said warmth-receiving means comprising an inner lining, an outer lining and a heat-insulating material filling a space defined by said inner and outer linings said elastic means being fixed to said outer lining.

12. A sleeping bag device comprising:

warmth-retaining means defining an elongated inner chamber for accommodating a user's body and being capable of thermally insulating the interior of said inner chamber from the ambient air;

a head opening provided adjacent one end of said warmth-retaining means and serving as an entrance/exit for enabling a user to enter and leave said inner chamber; and elastic means spaced longitudinally from said head opening for compressing said warmth-retaining means in such a direction as to reduce the cross-sectional area of said inner chamber.

13. A sleeping bag device according to claim 12, wherein said elastic means is provided adjacent the head opening end of said warmth-retaining means.

14. A sleeping bag device according to claim 13, wherein an elastic means is provided in a portion adjacent an opposite end of said warmth-retaining means from said head opening to reduce said inner chamber around the ankles of a user.

15. A sleeping bag device according to claim 12, wherein said elastic means is provided at a substantially constant pitch in the longitudinal direction of said warmth-retaining means over the entire length of said warmth-retaining means.

* * * * *

UNITED STATES PATENT AND TRADEMARK OFFICE

CERTIFICATE OF CORRECTION

PATENT NO. : 4,888,828

DATED : December 26, 1989

INVENTOR(S) : Isamu TATSUNO

It is certified that error appears in the above-indentified patent and that said Letters Patent is hereby corrected as shown below:

Column 5, line 4, line 9, change "warmthretaining" to --warmth-retaining--.

Column 5, line 19, after "as" insert --an--.

Column 6, line 6, after "as" insert --an--;

Column 6, line 8, change "warmthretaining" to --warmth-retaining--; and

Column 6, line 12, change "warmth-receiving" to --warmth-retaining--.

Signed and Sealed this

Fourteenth Day of May, 1996

*Attest:*

*Attesting Officer*

BRUCE LEHMAN

*Commissioner of Patents and Trademarks*